US006124253A

United States Patent [19]

Vinci et al.

[11] Patent Number: 6,124,253

[45] Date of Patent: Sep. 26, 2000

[54] AQUEOUS COMPOSITION FOR LOW-TEMPERATURE METAL-CLEANING AND METHOD OF USE

[75] Inventors: Alfredo Vinci, Trenton; Steven A. Bolkan, Hopewell, both of N.J.; Paul E. DeCastro, Morrisville, Pa.; Lisa M. Kurschner, Hamilton Square, N.J.

[73] Assignee: Church & Dwight Co., Inc., Princeton, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 08/931,512

[22] Filed: Sep. 16, 1997

[51] Int. Cl.[7] ..... C11D 1/72; C11D 3/10; C11D 3/28

[52] U.S. Cl. ..... 510/254; 510/245; 510/265; 510/421; 510/423; 510/424; 510/427; 510/433; 510/434; 510/435; 510/500

[58] Field of Search ..... 510/254, 258, 510/265, 421, 423, 424, 427, 433, 434, 500, 435, 245; 134/40, 41, 42

[56] References Cited

U.S. PATENT DOCUMENTS

| | | | |
|---|---|---|---|
| 4,113,498 | 9/1978 | Rones et al. | 106/14.13 |
| 4,242,214 | 12/1980 | Lambert, Jr. | 252/75 |
| 4,537,708 | 8/1985 | Downey et al. | 510/325 |
| 4,597,889 | 7/1986 | Jones et al. | 510/339 |
| 4,931,205 | 6/1990 | Edwards et al. | 252/174.21 |
| 5,076,954 | 12/1991 | Loth et al. | 252/122 |
| 5,093,031 | 3/1992 | Login et al. | 252/357 |
| 5,110,494 | 5/1992 | Beck | 252/156 |
| 5,264,047 | 11/1993 | Winston et al. | 134/42 |
| 5,342,450 | 8/1994 | Cockrell, Jr. et al. | 134/19 |
| 5,431,847 | 7/1995 | Winston et al. | 252/174.24 |
| 5,464,553 | 11/1995 | Winston et al. | 252/108 |
| 5,549,761 | 8/1996 | Winston et al. | 134/40 |
| 5,558,109 | 9/1996 | Cala et al. | 134/42 |
| 5,593,504 | 1/1997 | Cala et al. | 134/1 |
| 5,614,027 | 3/1997 | Dunn et al. | 134/2 |
| 5,650,385 | 7/1997 | Dunn et al. | 510/245 |
| 5,688,753 | 11/1997 | Cala et al. | 510/175 |
| 5,736,495 | 4/1998 | Bolkan et al. | 510/202 |
| 5,747,439 | 5/1998 | Dunn et al. | 510/255 |
| 5,755,893 | 5/1998 | Cala et al. | 134/2 |

FOREIGN PATENT DOCUMENTS

| | | |
|---|---|---|
| 0616026 | 9/1994 | European Pat. Off. . |
| 2758629 | 7/1978 | Germany . |
| 19532304 | 3/1997 | Germany . |
| WO 96/09366 | 3/1996 | WIPO . |
| WO 96/09368 | 3/1996 | WIPO . |
| WO 97/05222 | 2/1997 | WIPO . |

OTHER PUBLICATIONS

McCutcheon's Emulsifiers & detergents, p. 202, 1982. (No Month Available).

*Primary Examiner*—Gregory R. Delcotto
*Attorney, Agent, or Firm*—Irving M. Fishman

[57] ABSTRACT

An alkaline, aqueous metal-cleaning composition capable of effectively removing industrial-type soil contaminants from a metal surface at temperatures as low as ambient temperature and in the absence of substantial agitation contains (A) an active-ingredient portion containing (1) an alkalinity-providing component, and (2) a surfactant mixture containing: (a) at least one first non-ionic, ethoxylated linear primary alcohol surfactant having a hydrophobic carbon chain length of from 9 to 11 carbon atoms and being ethoxylated with (i) an average of 2.5 moles of ethylene oxide or (ii) an average of 5.0 moles of ethylene oxide; and (b) at least one second non-ionic, ethoxylated linear primary alcohol surfactant having a hydrophobic carbon chain length of from 9 to 11 carbon atoms and being ethoxylated with an average of 6.0 moles of ethylene oxide; and (B) an aqueous portion.

18 Claims, 1 Drawing Sheet

AQUEOUS COMPOSITION FOR LOW-TEMPERATURE METAL-CLEANING AND METHOD OF USE

BACKGROUND OF THE INVENTION

This invention relates to metal-cleaning compositions. More particularly, this invention relates to an aqueous metal-cleaning composition and method of using same, wherein the composition is capable of substantially removing industrial-type soil contaminants from metal surfaces at low wash temperatures without the help of any mechanical action.

Many industries, such as, for example, automobile parts repair and replacement services and the like, require that component mechanical parts be cleaned prior to inspection, repair, or replacement thereof. Generally, such parts have been exposed to various industrial-type soil contaminants such as dirt, grease, oil, ink and the like, which must be removed for effective repair or service.

A variety of metal cleaners have been used to clean such mechanical parts. For example, solvent-based metal cleaners have been used which contain either halogenated or non-halogenated hydrocarbons. Aqueous-based, highly alkaline detergent systems have also been used to clean metal parts. However, the use of such solvent-based or aqueous-based cleaners has raised environmental and/or worker safety concerns.

For example, although halogenated hydrocarbon solvents such as chlorofluorocarbons (CFCs), trichloromethane, methylene chloride and trichloroethane (methyl chloroform) have been widely used in industry for metal cleaning, the safety, environmental and cost factors associated with their use coupled with waste disposal problems are negative aspects of the use of such solvents. A world-wide and U.S. ban on most halogenated solvents is soon in the offing by virtue of the Montreal Protocol, Clean Air Act and Executive and Departmental directives.

Non-halogenated hydrocarbon solvents such as toluene, Stoddard solvent and like organic compounds such as ketones and alcohols are generally flammable and highly volatile and have dubious ability to be recycled for continuous use. These factors, along with unfavorable safety, environmental and cost factors, make the non-halogenated hydrocarbon solvents unattractive for practical consideration. For example, the most useful organic solvents, classified as volatile organic compounds (VOCs), pollute the atmosphere, promote formation of a toxic zone at ground level, and add to the inventory of greenhouse gases.

Aqueous cleaning systems have been developed to overcome some of the inherent negative environmental and health aspects associated with the solvent-based cleaning systems. Unfortunately, aqueous cleaning systems also have drawbacks.

For example, aqueous solutions used to clean industrial-type soil contaminants from metal surfaces are generally effective only at relatively high wash temperatures, e.g., 140° F. and above. Such high wash temperatures are disadvantageous because of the higher energy costs which are involved relative to lower temperature washing and the difficulty with maintaining such high temperatures. Unfortunately, with aqueous solutions, a reduced wash temperature usually leads to reduced cleaning versus that obtained at higher wash temperatures. It would be desirable, therefore, to provide an aqueous metal-cleaning composition which provides high cleaning performance at relatively low wash temperatures.

Another advantage associated with the use of aqueous cleaners stems from the high surface tension of water and the propensity of the detersive agents in the aqueous cleaner to foam upon agitation of the cleaning bath such as induced in the bath or by the use of spray nozzles to apply the cleaning solution to the metal components being cleaned. The foaming profile of an aqueous cleaner is an important characteristic. The presence of foam often renders the use of machines with high mechanical agitation impractical due to excessive foaming. High foaming cleaners are particularly problematic in spray equipment. In addition to foam exiting the equipment, foaming can cause pump cavitation and selective loss of surfactants. Also, the presence of foam can cause the overflow of liquids onto floors as well as cause difficulties with viewing the cleaning process through vision ports and the like contained in the machinery. Contrary to popular belief, foaming does not contribute to cleaning and, therefore, is not necessary for immersion or spray cleaning. Generally, low foaming cleaners are preferred because they can be used in dip, immersion, ultrasonic and spray equipment.

It has been found that, in conventional aqueous metal-cleaning compositions, foam formation will decrease with increased temperature. Thus, with such compositions, the use of relatively low wash temperatures tends to lead to high foam formation, which renders such cleaning compositions unsuitable for use at low temperatures.

As stated above, agitation of the cleaning solution appears to induce foaming. Thus, one way to reduce foam formation would be to reduce or eliminate the agitation of the cleaning solution. It would be desirable, therefore, to provide an aqueous metal-cleaning composition which is capable of substantially removing industrial-type soil contaminants from metal surfaces at low wash temperatures without substantial agitation of the cleaning composition, thereby avoiding excessive foaming during use of the composition.

A further drawback associated with aqueous cleaners containing sodium hydroxide or organic solvents such as alkanolamine, ethers, alcohols, glycols and the like, is that such cleaners tend to be exceedingly alkaline, i.e., having pHs of 13 and above. These exceedingly alkaline aqueous solutions are highly corrosive to metal surfaces, highly toxic and can be dangerous to handle, thus requiring extreme safety measures to avoid contact with the skin. Organic solvent-containing aqueous cleaners have the toxicity and environmental problems discussed previously herein.

Thus, it is also desirable to provide a low-temperature aqueous cleaning composition which is not highly corrosive to metal surfaces, toxic or dangerous to handle.

It is also important that the aqueous metal cleaners be reusable to render such cleaners economically viable. Thus, it is not practical on an industrial scale to sewer an aqueous cleaning bath upon a single usage thereof. Many of the aqueous-based cleaners now available use detersive agents which are effective in removing the dirt, grease or oil from the metal surface but which unfortunately readily emulsify the contaminants such that the contaminants are highly dispersed or solubilized throughout the aqueous solution. These highly emulsified cleaning solutions are difficult to treat to separate the contaminants from the aqueous cleaner and, accordingly, the cleaning solution gets spent in a relatively short period of time and must be replaced to again achieve effective cleaning of the metal parts and the like. It would be desirable to provide an aqueous metal cleaner which could effectively remove the contaminants from the metal surface but which would allow the ready separation of such contaminants from the cleaning solution to allow effective and prolonged reuse of the solution.

In addition to the above-recited desirable characteristics, it is also desirable that an aqueous metal cleaner be compatible with a relatively wide variety of metals so that such cleaner can be used to clean a wide variety of metal substrates.

Accordingly, a primary object of this invention is to provide an aqueous metal-cleaning composition capable of effectively removing industrial-type soil contaminants from metal surfaces at relatively low wash temperatures.

A further object of this invention is to provide an aqueous cleaning composition which is capable of effectively removing industrial-type soil contaminants from metal surfaces at relatively low wash temperatures and in the absence of substantial agitation of the aqueous cleaning composition, thereby avoiding substantial foaming of the composition during use thereof.

A still further object of this invention is to provide a low-temperature, aqueous metal-cleaning composition which effectively removes industrial-type soil contaminants from a metal surface but which also allows ready separation of the soil contaminants from the aqueous composition so as to permit effective and prolonged use of the cleaning composition.

Another object of this invention is to provide a low-temperature, aqueous metal-cleaning composition which is not highly corrosive to metals, toxic or dangerous to handle.

A further object of this invention is to provide a low-temperature, aqueous metal-cleaning composition which is compatible with a relatively wide variety of metals.

Still another object of this invention is to provide a method of removing industrial-type soil contaminants from metal surfaces at low temperatures by means of an alkaline aqueous cleaning composition having the properties described in the foregoing objects.

These and other objects which are achieved according to the present invention can be readily discerned from the following description.

SUMMARY OF THE INVENTION

The present invention is based on the discovery that the use of a specific surfactant formulation in an alkaline, aqueous cleaning composition will provide such cleaning composition with improved ability to clean metal surfaces at relatively low wash temperatures and in the absence of substantial agitation of the cleaning composition. Specifically, this invention is based on the discovery that a surfactant mixture containing ethoxylated linear primary alcohol surfactants having a relatively short hydrophobic carbon chain length will provide significantly better low-temperature metal-cleaning properties to an alkaline, aqueous metal cleaner than does an ethoxylated linear primary alcohol surfactant having a relatively long hydrophobic carbon chain length.

Accordingly, one aspect of this invention is directed to an alkaline, aqueous metal-cleaning composition containing:

(A) an active-ingredient portion composed of:
  (1) an alkalinity-providing component; and
  (2) a surfactant mixture containing:
    (a) at least one first non-ionic, ethoxylated linear primary alcohol surfactant having a hydrophobic carbon chain length of from 9 to 11 carbon atoms and being ethoxylated with (i) an average of 2.5 moles of ethylene oxide or (ii) an average of 5.0 moles of ethylene oxide; and
    (b) at least one second non-ionic, ethoxylated linear primary alcohol surfactant having a hydrophobic carbon chain length of from 9 to 11 carbon atoms and being ethoxylated with an average of 6.0 moles of ethylene oxide; and (B) an aqueous portion.

In preferred embodiments of this invention, the active-ingredient portion of the composition further contains an N-alkylpyrrolidone surfactant, most preferably N-octylpyrrolidone. Also preferably, the active-ingredient portion of the composition of this invention contains at least one anionic surfactant.

The cleaning composition of this invention is preferably provided in the form of an aqueous concentrate which is further diluted in water for use.

Another aspect of this invention is directed to a method of removing industrial-type soil materials from a metal surface contaminated therewith by means of the composition of this invention. Such method involves applying the metal-cleaning composition to the contaminated metal surface at a temperature of preferably no more than about 110° F. and for a period of time sufficient to remove all or substantially all of the soil contaminants from the metal surface. The wash temperature used in the cleaning method of this invention is preferably no more than about 110° F., more preferably from about 70° F. to about 100° F., and most preferably from about 70° F. to less than about 90° F. Preferably, the cleaning of the metal surface with the cleaning composition of this invention takes place without substantial agitation of the aqueous composition against the metal surface.

A further aspect of this invention is directed to the active-ingredient portion of the aqueous cleaning composition of this invention.

A primary advantage of the aqueous cleaning composition of this invention is that it is capable of effectively removing industrial-type soil contaminants from metal surfaces at relatively low wash temperatures.

A further advantage of the aqueous cleaning composition of this invention is that it is capable of effectively removing industrial-type soil contaminants from metal surfaces at relatively low wash temperatures and in the absence of substantial agitation of the aqueous cleaning composition, thereby avoiding substantial foaming of the composition during use thereof.

Another advantage of the aqueous metal-cleaning composition of this invention is that it effectively removes industrial-type soil contaminants from a metal surface and also allows ready separation of the soil contaminants from the aqueous composition so as to permit effective and prolonged use of the cleaning composition.

Yet another advantage of the aqueous cleaning composition of this invention is its compatibility with a relatively wide variety of metal substrates.

In addition to the foregoing advantages, the composition of this invention is environmentally safe, substantially non-corrosive to metal, non-toxic, and not dangerous to handle.

DETAILED DESCRIPTION OF THE INVENTION

Figure 1:
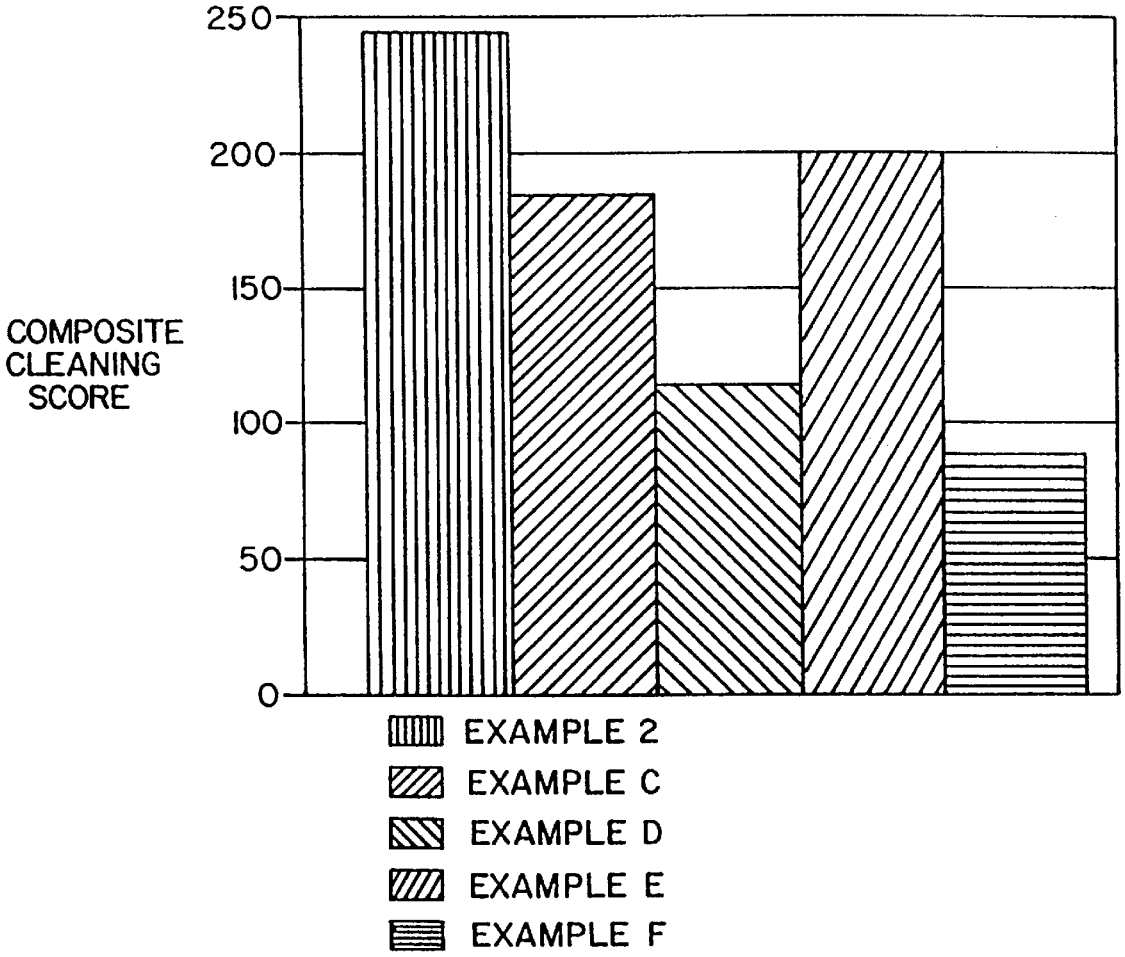
FIG. 1 is a graph setting forth composite cleaning scores obtained at 70° F. for an aqueous metal-cleaning composition of this invention and various commercially available metal-cleaning compositions.

As stated above, this invention is directed to an aqueous metal-cleaning composition and a method of using same, wherein the composition contains a surfactant formulation that enables the composition to effectively remove industrial-type soil contaminants from a metal surface at a relatively low wash temperature and in the absence of substantial agitation of the cleaning composition against the metal surface.

As used herein, the term "industrial-type soil contaminants" refers to contaminants such as, for example, greases, oils, lubricants, rust preventatives, and other processing soils.

The term "agitation" as used herein with respect to the cleaning composition of this invention is meant to include not only agitation-type movement of the composition but also circulation of the composition.

The aqueous cleaning composition of this invention is alkaline and preferably has a pH of more than about 7.5 up to about 11.0 so as to render the composition substantially less harmful to use and handle than highly alkaline aqueous cleaners such as those formed from sodium hydroxide or aqueous alkanolamine solutions. More preferably, the aqueous cleaning composition of this invention has a pH of at least about 8.0 to less than about 11.0 to effectively clean the typical metal surface. Most preferably, the aqueous cleaning composition of this invention has a pH of from about 8.0 to about 10.0, which is effective to remove the dirt, grease, oil and other contaminants from the metal surface without causing tarnishing or discoloration of the metal substrate and yet allow the cleaning solution to be used, handled and disposed of without burning or irritating human skin.

The aqueous cleaning composition of this invention contains (A) an active-ingredient portion composed of an alkalinity-providing component and a surfactant mixture, and (B) an aqueous portion. The surfactant mixture is composed of (a) at least one first non-ionic, ethoxylated linear primary alcohol surfactant having a hydrophobic carbon chain length of from 9 to 11 carbon atoms and being ethoxylated with (i) an average of 2.5 moles of ethylene oxide or (ii) an average of 5.0 moles of ethylene oxide; and (b) at least one second non-ionic, ethoxylated linear primary alcohol surfactant having a hydrophobic carbon chain length of from 9 to 11 carbon atoms and being ethoxylated with an average of 6.0 moles of ethylene oxide.

The alkalinity-providing component (A)(1) present in the aqueous cleaning composition of this invention can be composed of one or more alkaline salts. Suitable alkaline salts or mixtures thereof are those capable of providing the desired pH. Most suitable are the salts of potassium and sodium. Especially preferred are the potassium and sodium carbonates and bicarbonates, which are safe, economical and environmentally friendly. The carbonate salts include, e.g., potassium carbonate, potassium carbonate dihydrate, potassium carbonate trihydrate, sodium carbonate, sodium carbonate decahydrate, sodium carbonate monohydrate, sodium sesquicarbonate and the double salts and mixtures thereof. The bicarbonate salts include potassium bicarbonate and sodium bicarbonate and mixtures thereof. Mixtures of the carbonate and bicarbonate salts are also especially useful.

Although not preferred, other suitable alkaline salts which can be used as the alkalinity-providing component include the alkali metal ortho or complex phosphates. The complex phosphates are especially effective because of their ability to chelate water hardness and heavy metal ions. The complex phosphates include, for example, sodium or potassium pyrophosphate, tripolyphosphate and hexametaphosphates.

Additional suitable alkaline salts useful as the alkalinity-providing component include the alkali metal borates, acetates, citrates, tartrates, succinates, silicates, phosphonates, edates, etc.

In particularly preferred embodiments of the present invention, the alkalinity-providing component is a mixture of potassium carbonate and potassium bicarbonate or a mixture of potassium carbonate and sodium carbonate.

The alkalinity-providing component is preferably present in the aqueous cleaning composition of this invention in an amount sufficient to provide the composition with an alkaline pH in the ranges recited previously herein, i.e., preferably above about 7.5 and up to about 11.0, more preferably from at least about 8.0 to about 11.0, and most preferably from about 8.0 to about 10.0.

Preferably, the active-ingredient portion of the cleaning composition of this invention contains from about 20% to about 80% by weight of the alkalinity-providing component.

In the surfactant mixture (A)(2) of the cleaning composition of this invention, surfactant component (a) is composed of at least one (preferably a blend of) first non-ionic, ethoxylated linear primary alcohol surfactant having a hydrophobic carbon chain length of from 9 to 11 carbon atoms and being ethoxylated with (i) an average of 2.5 moles of ethylene oxide or (ii) an average of 5.0 moles of ethylene oxide. Shorthand designations for surfactants which can serve as surfactant components (2)(a)(i) and (2)(a)(ii) are $C_{9-11}(EO)_{2.5}OH$ and $C_{9-11}(EO)_5OH$, respectively. Particularly suitable $C_{9-11}(EO)_{2.5}OH$ and $C_{9-11}(EO)_5OH$ surfactants which can serve as respective surfactants (2)(a) (i) and (2)(a)(ii) are commercially available from Shell Chemical Company under the designations Neodol® 91-2.5 and Neodol® 91-5, respectively.

Surfactant component (2)(b) of the surfactant mixture is composed of at least one second non-ionic, ethoxylated linear primary alcohol surfactant having a hydrophobic carbon chain length of from 9 to 11 carbon atoms and being ethoxylated with an average of 6.0 moles of ethylene oxide. A shorthand designation for surfactant component (2)(b) is $C_{9-11}(EO)_6OH$. A particularly suitable surfactant which can be used as surfactant (2)(b) in the composition of this invention is commercially available from Shell Chemical Company under the designation Neodol® 91-6.

At room temperature, the surfactants Neodol® 91-2.5, Neodol® 91-5.0 and Neodol® 91-6.0 are high purity, colorless liquids or pastes and resemble fatty alcohols in chemical behavior.

The amount of surfactant mixture (A)(2) in the active-ingredient portion of the aqueous cleaning composition of this invention is preferably from about 5.0% to about 50.0% by weight.

In addition to providing the aqueous cleaning composition with excellent metal-cleaning ability at low temperatures and in the absence of substantial agitation, the surfactant mixture (A)(2) also have the benefit of not readily emulsifying the contaminants removed from the metal surface so that such contaminants readily separate from the cleaning solution. The separated contaminants can then be easily skimmed or otherwise easily separated from the wash bath for disposal. Consequently, the cleaning ability of the cleaning composition can be maintained for prolonged reuse.

In the most preferred embodiments of the aqueous cleaning composition of this invention, the surfactant mixture (A)(2) further contains (c) at least one third surfactant which is an N-alkylpyrrolidone surfactant. A particularly preferred N-alkylpyrrolidone surfactant for use in this invention is an N-(n-alkyl)-2-pyrrolidone surfactant wherein the alkyl group contains from about 6 to about 15 carbon atoms. These compounds are described in U.S. Pat. No. 5,093,031, which is hereby incorporated by reference herein.

The most preferred N-alkyl pyrrolidone surfactant for use in this invention is N-octyl pyrrolidone which contains 8 carbon atoms in the alkyl group thereof. A suitable N-octyl pyrrolidone which can be used in this invention is commercially available from ISP Investments, Inc. under the designation "ISP Surfadone LP-100".

The N-alkyl pyrrolidone surfactant is preferably present in the active-ingredient portion of the aqueous cleaning composition of this invention in an amount of from about 5.0% to about 50.0% by weight.

To further improve the cleaning efficacy of the aqueous cleaning composition of this invention, the surfactant mixture (A)(2) of the aqueous cleaning composition of this invention may further contain (d) at least one fourth surfactant which is selected from the group consisting of anionic surfactants, nonionic surfactants and mixtures thereof. Nonionic surfactants are preferred as such surfactants are best able to remove dirt, grease, and oil from the metal surfaces. However, anionic surfactants may also be used.

Particularly useful surfactants in terms of the ability thereof to remove grease and oil are the nonionic alkoxylated thiol surfactants. Such surfactants are known in the art and are described, e.g., in U.S. Pat. No. 5,614,027, which is hereby incorporated by reference herein. Especially preferred is an ethoxylated dodecyl mercaptan having about 6 ethylene oxide units. Such a surfactant is a commercial product known as Alcodet 260, marketed by Rhone-Poulenc.

Other suitable surfactants which can serve as surfactant (d) in the surfactant mixture used in the composition of this invention are non-ionic ethoxylated surfactants. Non-limiting examples of suitable non-ionic ethoxylated surfactants include the polyoxyethylene-polyoxypropylene condensates, which are sold by BASF under the tradename "Pluronic"; polyoxyethylene condensates of aliphatic alcohols/ethylene oxide condensates having from 1 to 30 moles of ethylene oxide per mole of coconut alcohol; ethoxylated long chain alcohols sold by Shell Chemical Co. under the tradename "Neodol"; polyoxyethylene condensates of sorbitan fatty acids; alkanolamides such as the monoalkanolamides, dialkanolamides and the ethoxy alkanolamides, e.g., coconut monoethanolamide, lauric isopropanolamide and lauric diethanolamide; and amine oxides, e.g., dodecyldimethylamine oxide.

Non-limiting examples of suitable anionic surfactants which can serve as surfactant (d) in the surfactant mixture include water-soluble salts of the higher alkyl sulfates such as sodium lauryl sulfate or other suitable alkyl sulfates having 8 to 18 carbon atoms in the alkyl group; water-soluble salts of higher fatty acid monoglyceride monosulfates, such as the sodium salt of the monosulfated monoglyceride of hydrogenated coconut oil fatty acids; alkyl aryl sulfonates such as sodium dodecyl benzene sulfonate; higher alkyl sulfoacetates; higher fatty acid esters of 1,2-dihydroxy propane sulfonate; and the substantially saturated higher aliphatic acyl amides of lower aliphatic amino carboxylic acid compounds such as those having 12 to 16 carbon atoms in the fatty acid, alkyl or acyl radicals, and the like. Examples of the last-mentioned amides are N-lauroyl sarcosinate, and the sodium, potassium and ethanolamine salts of N-lauroyl, N-myristoyl, or N-palmitoyl sarcosinate sold by W.R. Grace under the tradename "Hamposyl". Also effective are polycarboxylated ethylene oxide condensates of fatty alcohols manufactured by Olin under the tradename of "Polytergent CS-1".

In preferred embodiments of the aqueous cleaning composition of this invention, surfactant (d) of surfactant mixture (A)(2) is composed of a mixture of a nonionic, ethoxylated linear primary alcohol surfactant having a hydrophobic carbon chain length of 11 carbon atoms and ethoxylated with 3 moles of ethylene oxide (i.e., $C_{11}(EO)_3OH$) and a nonionic, ethoxylated linear primary alcohol surfactant having a hydrophobic carbon chain length of 11 carbon atoms and ethoxylated with 7 moles of ethylene oxide (i.e., $C_{11}(EO)_7OH$). Such surfactants are commercially available from Shell Chemical Company under the tradenames "Neodol 1-3" and "Neodol 1-7", respectively.

An especially preferred surfactant formulation for use as surfactant mixture (A)(2) in the cleaning composition of this invention is composed of:

(a) a blend of the $C_{9-11}(EO)_{2.5}OH$ surfactants or a blend of the $C_{9-11}(EO)_5OH$ surfactants;

(b) a blend of the $C_{9-11}(EO)_6OH$ surfactants;

(c) an N-octyl pyrrolidone surfactant; and (d) a blend composed of the $C_{11}(EO)_3OH$ surfactants and the $C_{11}(EO)_7OH$ surfactants.

The cleaning composition of this invention may further contain one or more adjuvants conventionally used in aqueous cleaning compositions.

For example, the active-ingredient portion of the composition of this invention may further contain one or more hydrotropes. Hydrotropes tend to keep surfactants readily dispersed in aqueous compositions.

Suitable hydrotropes for use in this invention include the sodium, potassium, ammonium, and alkanol ammonium salts of xylene, toluene, ethylbenzoate, isopropylbenzene, naphthalene, alkyl naphthalene sulfonates, phosphate esters of alkoxylated alkyl phenols, phosphate esters of alkoxylated alcohols and sodium, potassium and ammonium salts of the alkyl sarcosinates.

A particularly preferred hydrotrope for use in the present invention is one that does not foam. Among the most useful of such hydrotropes are the alkali metal salts of intermediate chain length (i.e., $C_7$–$C_{13}$) monocarboxylic fatty acids. The most preferred of these hydrotropes are the alkali metal octanoates and nonanoates.

A nonionic defoamer may also be used in the active-ingredient portion of the composition of this invention. Particularly useful defoamers include nonionic alkoxylated fatty alcohols.

The active-ingredient portion of the aqueous cleaning composition of this invention may further contain one or more corrosion inhibitors. Examples of corrosion inhibitors which can be used in the composition of this invention include magnesium and/or zinc ions. Preferably, such metal ions are provided in water-soluble form. Examples of useful water-soluble forms of magnesium and zinc ions are the water-soluble salts thereof, including the chlorides, nitrates, and sulfates of the respective metals. If the alkalinity-providing component is an alkali metal carbonate, bicarbonate or mixture of such salts, magnesium oxide can be used to provide the magnesium ion. The magnesium oxide is water-soluble in such solutions and is a preferred source of magnesium ions. The magnesium oxide appears to reduce the discoloration of the metal substrates even when compared with the chloride salt.

In order to maintain the dispersibility of the magnesium and/or zinc corrosion inhibitors in aqueous solution, in particular under the mildly alkaline pH conditions most useful in this invention and in the presence of agents which would otherwise cause precipitation of the zinc or magnesium ions, e.g., carbonates, phosphates, and the like, it has been found advantageous to include a carboxylated polymer to the aqueous metal-cleaning composition of this invention. Examples of suitable carboxylated polymers are disclosed, e.g., in U.S. Pat. No. 5,614,027, which is hereby incorporated by reference herein.

The useful carboxylated polymers may be generically categorized as water-soluble carboxylic acid polymers such as polyacrylic and polymethacrylic acids or vinyl addition polymers. Of the vinyl addition polymers contemplated, maleic anhydride copolymers as with vinyl acetate, styrene, ethylene, isobutylene, acrylic acid and vinyl ethers are preferred.

All of the above-described polymers are water-soluble or at least colloidally dispersible in water. The molecular weight of these polymers may vary over a broad range although it is preferred to use polymers having average molecular weights of from 1000 up to 1,000,000, more preferably from 1000 to 100,000, and most preferably from 1000 to 10,000.

The active-ingredient portion of the cleaning composition of this invention may further contain one or more polymeric anti-precipitating agents. Such agents prevent precipitation of water hardness salts and insoluble silicates formed during reaction with the alkaline salts of the cleaning composition of this invention. By preventing such precipitation, the anti-precipitating agents also prevent scaling caused by such precipitation.

Anti-precipitating agents suitable for use in the present invention may be generically categorized as water-soluble carboxylic acid polymers or as vinyl addition polymers. Polyacrylates are especially preferred as the anti-precipitating agent. Of the vinyl addition polymers contemplated, maleic anhydride copolymers as with vinyl acetate, styrene, ethylene, isobutylene, acrylic acid and vinyl ethers are preferred.

All of the above-described polymeric anti-precipitating agents are water-soluble or at least colloidally dispersible in water. The molecular weight of these polymers may vary over a broad range although it is preferred to use polymers having average molecular weights ranging between 1000 up to 1,000,000, more preferably 100,000 or less and, most preferably, between 1000 and 10,000. While higher molecular weight polymers may be used, there is no particular advantage in their use because they tend to be broken down due to the shear forces found in recirculating cooling systems. Also, when used in larger amounts in concentrated formulas, the higher molecular weight polymers tend to produce highly viscous products which are difficult to use.

The most preferred anti-precipitating agents for use in the composition of this invention are polycarboxylates.

The active-ingredient portion of the aqueous cleaning composition of this invention may contain from about 20% to 80% by weight of the alkalinity-providing component, from about 80% to about 20% by weight of the surfactant mixture, from 0% to about 10% by weight of a corrosion inhibitor, from 0% to about 2% by weight of a carboxylated polymer, from 0% to about 30% by weight of a hydrotrope, and from 0% to about 10% by weight of an anti-precipitating component.

If the alkalinity-providing component is the preferred carbonate and bicarbonate salts, the combination of such salts should be present in the active-ingredient portion of the aqueous cleaning composition of this invention in amounts of from 20% to 80% by weight. Preferably, if such a mixture is used, the amount of bicarbonate salts should comprise from about 5% to about 80% by weight and the carbonate salts from about 5% to about 60% by weight of the active-ingredient portion.

The aqueous component of the cleaning composition of this invention preferably consists essentially of water, preferably water which has been deionized, distilled or purified by reverse osmosis treatment and the like.

The aqueous cleaning composition of this invention and resultant aqueous cleaning solution formed therefrom as discussed below are each preferably free of organic solvents such as, e.g., hydrocarbon, halohydrocarbon, and oxygenated hydrocarbon solvents.

The aqueous cleaning composition of this invention is preferably provided and added to the wash bath as an aqueous concentrate. Preferably, the concentrate contains from about 5% to about 45% by weight of the active-ingredient portion and from about 55% to about 95% by weight of the aqueous portion. More preferably, the aqueous concentrate contains from about 5% to about 20% by weight of the active-ingredient portion and from about 80% to about 95% by weight of the aqueous portion.

The aqueous cleaning concentrate is typically used in the method of this invention at a dilution in water of 10% by volume (10×). However, smaller or higher dilution rates are also within the scope of the present invention and most likely will range from dilutions of 5× to 20× based on the dilution of the concentrate. Deionized water is preferably used to form the concentrate and for diluting the concentrate and washing the metal surfaces.

The aqueous cleaning solution used to clean the metal surfaces in accordance with this invention preferably contains from about 0.1% to about 20% by weight of the active-ingredient portion and from about 80% to about 99.9% by weight of the aqueous portion, more preferably from about 0.2% to about 5% by weight of the active-ingredient portion and from about 95% to about 99.8% by weight of the aqueous portion.

In a particularly preferred embodiment thereof, the aqueous cleaning solution of this invention has the following formulation:

Sodium Carbonate Monohydrate—3.00% by weight
Sodium Bicarbonate—0.25% by weight
Polyacrylate polymer—1.00% by weight
N-octyl pyrrolidone—2.00% by weight
$C_{9-11}(EO)_{2.5}OH$—1.80% by weight
$C_{9-11}(EO)_6OH$—4.20% by weight
$C_{11}(EO)_3OH$—0.50% by weight
$C_{11}(EO)^7OH$—1.50% by weight
Water—85.75% by weight Another aspect of the present invention is directed to the active-ingredient portion of the cleaning composition of this invention. Thus, this aspect of the invention is directed to a non-aqueous, metal-cleaning composition capable of being combined with an aqueous component to form the aqueous cleaning composition of this invention, wherein the metal-cleaning composition is composed of the aforementioned alkalinity-providing component in an amount sufficient to provide the aqueous composition with an alkaline pH, and the aforementioned surfactant formulation containing surfactants (i)–(iii), wherein the active concentrations of surfactants (i)–(iii) are such as to render the aqueous composition capable of removing at least a substantial portion of industrial-type soil contaminants from a metal surface at a relatively low temperature and in the absence of substantial agitation.

As stated previously herein, the present invention also provides a method of cleaning a metal surface having industrial-type soil contaminants disposed thereon. The method of this invention involves the steps of:

(1) providing the alkaline, aqueous metal-cleaning composition of this invention; and (2) applying the metal-cleaning composition to a metal surface having industrial-type soil contaminants disposed thereon, the metal-cleaning composition being applied to the metal surface at a temperature of no more than about 110° F. and for a period of time sufficient to remove all or substantially all of the soil contaminants from the metal surface.

The temperature of the cleaning composition while it is used to clean the contaminated metal surface is preferably no more than about 110° F., more preferably from about 70° F. to about 100° F., and most preferably from about 70° F. to less than about 90° F.

The contaminated metal surface is contacted with the aqueous cleaning composition for a period of time sufficient to remove all or substantially all of the soil contaminants from the metal surface. Such period of time will vary depending upon the degree of contamination but broadly will range from about 1 minute to about 30 minutes, with 5 to 15 minutes being more typical.

As stated previously herein, an advantage provided by the particular aqueous cleaning composition of this invention is that it is capable of cleaning metal surfaces at low wash temperatures in the absence of any substantial agitation or circulation of the aqueous cleaning solution against the metal surface. Thus, in a preferred embodiment of the method of this invention, the metal part whose surface is to be cleaned is immersed in the solution form of the aqueous cleaning composition of this invention in a low-temperature, low-agitation parts washer, e.g., vat.

After cleaning of the metal part, the cleaning solution can then be filtered and recycled for reuse in the parts washer.

The aqueous cleaning composition of this invention is useful in removing a variety of industrial-type soil contaminants from metal surfaces. Such contaminants include, e.g., greases, cutting fluids, lubricants, drawing fluids, machine oils, antirust oils such as cosmoline, mixed-lube products, carbonaceous soils, sebaceous soils, particulate matter, waxes, paraffins, used motor oil, fuels, printing inks, and the like.

The cleaning composition may be used to clean any metal surface on which industrial-type soil contaminants are disposed. Non-limiting examples of metals which are readily cleaned by means of the composition of this invention include, for example, steel, stainless steel, iron, aluminum, zinc, copper, brass, carbon steel, and other ferrous and non-ferrous metals and alloys. The structure of the metal surface to be cleaned can vary widely and is unlimited. Thus, the metal surface can be as a metal part of complex configuration, sheeting, coils, rolls, bars, rods, plates, disks, and the like. Such metal parts can be derived from any source including for home use, for industrial use such as from the aerospace industry, automotive industry, electronics industry, and the like, wherein the metal surfaces have to be cleaned.

As stated previously herein, the aqueous metal-cleaning composition of this invention has many advantages. A primary advantage of the composition of this invention is that it provides excellent cleaning at relatively low wash temperatures without the help of any mechanical action. Since agitation of the cleaning solution tends to induce foam formation therein, the absence of mechanical action in the method of this invention allows the aqueous metal-cleaning composition of this invention to provide excellent metal-cleaning at low temperatures without the generation of excessive foam.

The following examples illustrate but do not limit the present invention.

EXPERIMENTAL

Example 1 and Controls A and B

The examples below illustrate the effect of carbon chain length on the ability of an ethoxylated alcohol surfactant to clean metal at a low temperature.

In Example 1 and Controls A and B, three cleaning solutions were prepared, having the formulations set forth in Table 1 below.

TABLE 1

Example 1 and Controls A and B: Formulations

| Ingredient | Example No. Concentration (Weight %) 1 | A | B |
|---|---|---|---|
| Sodium Carbonate Monohydrate | 3.0 | 3.0 | 3.0 |
| Borax | 0.3 | 0.3 | 0.3 |
| Cobratec TT-100 | 0.3 | 0.3 | 0.3 |
| Alcosperse 415 polymer | 0.5 | 0.5 | 0.5 |
| NaOH (50%) | 1.0 | 1.0 | 1.0 |
| Belcore 577 | 1.0 | 1.0 | 1.0 |
| Sodium Silicate | 2.0 | 2.0 | 2.0 |
| Monatrope 1250 | 6.5 | 6.5 | 6.5 |
| Neodol ® 25-9 | 0 | 4.0 | 0 |
| Neodol ® 91-2.5 | 2.0 | 0 | 0 |
| Neodol ® 91-6 | 2.0 | 0 | 0 |
| Neodol ® 45-7 | 0 | 0 | 4.0 |
| Water | 81.4 | 81.4 | 81.4 |
| TOTAL | 100.0 | 100.0 | 100.0 |

The following terms used in Table 1 above are defined as set forth below:

"Neodol ® 91-2.5" - an ethoxylated anionic surfactant containing a $C_{9-11}$ carbon chain length and ethoxylated with an average of 2.5 moles of ethylene oxide (commercially available from Shell Chemical Company).

"Neodol ® 91-6" - an ethoxylated anionic surfactant containing a $C_{9-11}$ carbon chain length and ethoxylated with an average of 6 moles of ethylene oxide (commercially available from Shell Chemical Company).

"Neodol ® 25-9" - an ethoxylated anionic surfactant containing a $C_{12-15}$ carbon chain length and ethoxylated with an average of 9 moles of ethylene oxide (commercially available from Shell Chemical Company).

"Neodol ® 45-7" - an ethoxylated anionic surfactant containing a $C_{14-15}$ carbon chain length and ethoxylated with an average of 7 moles of ethylene oxide (commercially available from Shell Chemical Company).

"Alcosperse 415" - an acrylic acid copolymer available from Alco Chemical Corp., Chattanooga, Tennessee "Cobratec TT-100" - tradename for 1,2,3-benzotriazole by B. F. Goodrich "Monatrope 1250" - sodium salt of nonanoic acid, available from Mona Industries The solutions prepared in Example 1 and Controls A and B were each evaluated for their ability to remove two types of soils from a metal substrate at a relatively low temperature. Specifically, the solutions were each tested for their ability to remove white grease and gear lube from a metal substrate at a temperature of about 70° F. Cleaning of the metal substrates with the solutions prepared in Example 1 and Controls A and B was carried out gravimetrically using a modified Boeing test at room temperature (70° F.). The results are presented in Table 2 below.

TABLE 2

| Example 1 and Controls A and B: Cleaning Results | | |
|---|---|---|
| | Soil Type Percent Soil Removed | |
| Example No. | White Grease | Gear Lube |
| 1 | 89.1 | 88.0 |
| A | 60.06 | 58.02 |
| B | 43.77 | 56.87 |

The results set forth in Table 2 show that the cleaning composition containing shorter chain hydrophobes (Example 1) removed significantly more soil at 70° F. than did the cleaning compositions containing longer chain hydrophobes (Controls A and B).

Example 2 and Controls C–G

The examples presented below illustrate the cleaning performance, metal compatibility, oil-breaking capability and foaming profile at low temperatures of an aqueous cleaning composition within the scope of this invention. The examples further compare such characteristics of the cleaning composition of this invention with those of various commercially available metal cleaning compositions.

In Example 2 and Controls C–G, six cleaning solutions were prepared. The solution used in Example 2 was within the scope of the present invention. The solutions in Controls C–G were formed from commercially available metal cleaners.

The solution used in Example 2 was a solventless, aqueous-based composition having the formulation set forth in Table 3 below.

TABLE 3

| Example 2: Formulation | |
|---|---|
| Ingredient | Concentration (Weight %) |
| Sodium Carbonate Monohydrate | 3.00 |
| N-octylpyrrolidone | 2.00 |
| Neodol 91-2.5 | 2.00 |
| Neodol 91-6 | 2.00 |
| Borax (10 moles) | 0.3 |
| Cobratec TT-100 | 0.3 |
| Alcosperse 415 | 0.5 |
| NaOH Solution (50%) | 1.0 |
| Sodium Silicate | 2.0 |
| Monatrope 1250 | 6.5 |
| Alcodet 260 | 0 |
| Belcore 577 | 1.0 |
| Foam Blast 335NS | 0 |
| Distilled Water | 79.4 |

The solution used in Control C was an aqueous cleaner having the formulation set forth in Table 4 below.

TABLE 4

| Control C: Formulation | |
|---|---|
| Ingredient | Concentration (Weight %) |
| DI Water | 77.00 |
| Alcosperse 415 | 2.50 |
| NaOH Solution (50%) | 0.95 |
| Sodium Carbonate Monohydrate | 5.50 |
| PQ STAR Sodium Silicate | 1.80 |

TABLE 4-continued

| Control C: Formulation | |
|---|---|
| Ingredient | Concentration (Weight %) |
| Cobratec TT-100 | 0.25 |
| Borax, 10 moles | 0.25 |
| Monatrope 1250 Solution | 6.50 |
| Surfadone LP-100 | 1.50 |
| Alcodet 260 | 3.00 |
| Foam Blast 335NS | 0.75 |

The solution used in Control D was a water-based emulsion available from IPAX Cleanogel, Inc. under the designation Green Unikleen.

The Control E solution was prepared from a solvent-containing cleaner available from Sunshine Makers, Inc. under the designation Simple Green®. The solvent present in the Simple Green cleaner is a glycol ether, specifically, butyl cellusolve. The ingredients present in the Simple Green cleaner are listed in Table 5 below.

TABLE 5

| Control E: Ingredients |
|---|
| Octyl decyl dimethyl ammonium chloride |
| Dioctyl dimethyl ammonium chloride |
| Didecyl dimethyl ammonium chloride |
| Alkyl dimethyl benzyl ammonium chloride |
| Butyl Cellusolve |
| Surfactants |
| Wetting Agents |
| Buffers |

The solution used in Control F was a degreasing fluid available from ChemFree™ Corporation under the designation SmartWasher™.

The solution used in Control G was an aqueous cleaner available from Petroferm, Inc. under the designation Bio-Acts® 55. The formulation of the Control G solution is set forth in Table 6 below.

TABLE 6

| Control G: Formulation | |
|---|---|
| Ingredient | Concentration (% by Weight) |
| Dihydrogen oxide | 70–80 |
| Ethoxylated polyoxypropylene | 1–3 |
| Sodium xylene sulfonate | 8–12 |
| Ethoxylated dodecyl mercaptan | 3–6 |
| Sodium polyacrylate | 1–3 |
| Surfactant blend | 5–10 |

The cleaning compositions used in Example 2 and Controls C–G were each diluted to 10% by weight for each of the following analyses.

Cleaning Performance

Using a static cleaning test method described hereinbelow, the cleaning performance of the compositions used in Example 2 and Controls C–F was assessed at 70° F. In addition, the cleaning performance of the compositions of Controls C–G was assessed at 140° F., using a dynamic cleaning test method which is also discussed hereinbelow.

Static Cleaning Test Method (70° F.)

Cleaning performance of the compositions used in Example 2 and Controls C–F was assessed at 100° F. using a static cleaning method described below.

In the static cleaning method, four soils were applied to individual metal coupons which were immersed in separate beakers. Soil removal was determined gravimetrically and "percent soil removed" was calculated for each soil. For each cleaning composition, these four percentages were added to obtain a "composite cleaning score". A perfect score is 400 points (4 soils×100% removal).

In the static cleaning test method, the following four soils were used:

Soil #1: Cosmoline, which is a corrosion-preventative compound manufactured by Ralube Inc., Farmington Hills, Mich.);

Soil #2: Penziol 705 multi-purpose white grease;

Soil #3: Penziol 4096 Gear Lubricant SAE 80W/90; and

Soil #4: a mixed soil containing 30% by weight of the Penziol 705 white grease, 65% by weight of the Penziol 4096 gear lubricant and 5% by weight of carbon black.

The metal used in the static cleaning test method was 2024-type aluminum.

In the static cleaning test method, four 2024-type aluminum coupons were cleaned and labelled. The labelled coupons were then weighed to the fourth decimal place and the weight ("tare weight") recorded. One soil per coupon was applied, wherein 0.03 grams of the soil was applied in a thin even coat to one facial side of the coupon such that the soil covered about two-thirds of the facial side of the coupon. Each soiled coupon was then weighed and the weight ("initial weight") recorded. A sufficient quantity of a 10% dilution of each of the cleaning compositions was prepared in separate large beakers. The temperature of each of the resulting cleaning solutions was about 70° F. Then, 150 mL of each of the cleaning solutions was poured into four separate 250 mL-beakers. Then, one coupon was placed in each beaker and kept there without agitation for about ten minutes. The temperature of the cleaning solution in each beaker was about 70° F. After ten minutes, each coupon was removed from the beakers. Each coupon was gently tapped on the side of the beaker to remove excess solution. Each coupon was then placed in a convection oven set at 105° C. After ten minutes, each coupon was removed from the oven and cooled. The cooled coupons were then weighed and the weight recorded ("final weight").

The percentage of soil removed was calculated as follows:

$$\%\ \text{soil removed} = \frac{(\text{initial weight} - \text{final weight})}{(\text{initial weight} - \text{tare weight})} \times 100$$

As stated above, the "percent soil removed" was calculated for each soil so that for each cleaning composition there were four percentages calculated. For each cleaning composition, these four percentages were added to obtain a "composite cleaning score". A perfect score is 400 points (4 soils×100% removal). The composite cleaning scores obtained for the cleaning compositions are set forth in Table 7 and FIG. 1.

TABLE 7

Example 2 and Controls C–F: Cleaning Performance at 70° F.

| Example | Composite Cleaning Score |
|---|---|
| 2 | 246 |
| C | 183 |
| D | 117 |

TABLE 7-continued

Example 2 and Controls C–F: Cleaning Performance at 70° F.

| Example | Composite Cleaning Score |
|---|---|
| E | 200 |
| F | 92 |

The results presented in Table 7 and FIG. 1 show that the solution used in Example 2 (which was within the scope of the present invention) performed significantly better at 70° F. than did the other solutions tested.

Dynamic Cleaning Test Method (140° F.)

Cleaning performance of the compositions used in Controls C–G was assessed at 140° F. using a dynamic cleaning test method described below.

The dynamic cleaning test method used herein was a quantitative, gravimetric method employing nine replicates. Cleaning performance was determined by a difference in weight before and after cleaning. The result was an average of the nine replicates and was expressed as "percent soil removed".

In the dynamic cleaning test method which was used herein, forty-five labelled clean wire mesh screens were weighed on an analytical balance to the fourth decimal point. The weight of each screen was recorded. Then, each screen was soiled with from about 0.95 to about 1.05 grams of the soil mixture designated as "Soil #4" in the above-described static cleaning test method (i.e., a mixed soil containing 30% by weight of Penziol 705 Multi-Purpose White Grease, 65% by weight of Penziol 4096 Gear Lubricant SAE 80W-90, and 5% by weight of carbon black). For each screen, the soil mixture was spread over the bottom of the screen, covering an area one inch from the bottom. Each soiled screen was then weighed on an analytical balance to the fourth decimal point, and the weights recorded.

For each of Controls C–G, nine 250 ml-beakers were filled with 200 ml of the test aqueous cleaning solution at room temperature (for a total of 45 filled beakers (nine beakers×five test cleaning solutions)). A stirring bar was added to each beaker, and each beaker was then placed on a 9-place digital hot plate stirrer. Each stir bar was set for 600 rpm. The screens were suspended over the beakers (one screen per beaker) and then lowered into the solutions contained in the beakers. In such solutions, each screen was positioned away from the sides and bottom of the beaker, with the soiled portion of the screen being completely submerged. Each screen was then agitated for 15 minutes. The screens were then removed from the solutions and placed into a convection oven at 105° C. for about 30 minutes so as to remove any remaining water.

Each screen was then removed from the oven and allowed to cool to room temperature. After cooling, each screen was then weighed, and the weight recorded. The "percent clean" was calculated using the following formula:

$$\%\ \text{Clean} = \frac{[(\text{Amount of Oil}) - (\text{Amount of Residue})]}{[(\text{Amount of Oil})]} \times 100$$

For each cleaning solution tested, the average value of the nine "% clean" values obtained was determined. The results are presented in Table 8.

TABLE 8

Controls C–G: Cleaning Performance at 140° F.

| Example | % Clean |
|---|---|
| C | 69.5 |
| D | 30.1 |
| E | 28.9 |
| F | 27.8 |
| G | 31.3 |

The results set forth in Table 8 show that at 140° F., the solution used in Control C performed significantly better than the solutions used in Controls D–G. The performances of the solutions of Controls D–G did not significantly differ from one another.

Comparison of the results presented in Table 7 and those presented in Table 8 show that the cleaning temperature does affect the cleaning performance of the compositions tested. For example, at 70° F., the cleaning solution used in Control E cleaned significantly better than the solution used in Control C, whereas at 140° F., the Control C solution performed substantially better than the Control E solution.

Metal Compatibility

The metal compatibility of the cleaning compositions of Example 2 and Controls C–G at 100° F. was assessed by immersion of metal coupons for 24 hours. The following alloys were used:

1) Aluminum 2024
2) Aluminum 7075
3) Brass 260
4) Stainless Steel 304
5) Carbon Steel 4140

Each coupon was completely immersed in a separate beaker containing a 10% solution of the cleaner. The beakers were covered to prevent evaporation and placed in an oven for 24 hours. The samples were then removed, rinsed and visually compared to untreated samples.

The results of the 24-hour corrosion/staining tests are presented in Tables 9 and 10 below.

TABLE 9

Controls C–G: Corrosion/Staining at 160° F.

| Control | Al 2024 | Al 7075 | Brass 260 | Stainless Steel 304 | Carbon Steel 4140 |
|---|---|---|---|---|---|
| C | good | good | white residue | good | good |
| D | discolored | discolored | dulled | good | good |
| E | discolored | discolored | slightly dark | good | slightly dark |
| F | discolored | discolored | good | good | discolored |
| G | black | discolored | dulled | good | black |

TABLE 10

Example 2 and Controls D–G: Corrosion/Staining at 100° F.

| Example | Metal Alloy/Appearance | | | Stainless | Carbon |
|---|---|---|---|---|---|
| No. | Al 2024 | Al 7075 | Brass 260 | Steel 304 | Steel 4140 |
| 2 | good | good | good | good | good |
| D | white residue | white residue | dulled | good | good |
| E | discolored | discolored | good | good | good |
| F | slight dulling | discolored | slightly discolored | good | discolored |

TABLE 10-continued

Example 2 and Controls D–G: Corrosion/Staining at 100° F.

| Example | Metal Alloy/Appearance | | | Stainless | Carbon |
|---|---|---|---|---|---|
| No. | Al 2024 | Al 7075 | Brass 260 | Steel 304 | Steel 4140 |
| G | discolored | slightly discolored | dulled | good | black |

The results set forth in Table 10 show that the aqueous cleaning composition within the scope of the present invention (Example 2) did not corrode, stain or leave a residue on any of the substrates. All of the commercial cleaners (Controls D–G) stained or discolored aluminum even though the temperature was lower. The cleaners used in Controls D, F and G showed some improvement on aluminum relative to the results at the higher temperature (see Table 9); however, the level of staining was considered unacceptable. The white residue left by the cleaner used in Control D on aluminum could not be rinsed off. The cleaner used in Control E exhibited improved compatibility with brass and carbon steel at the lower temperature, while the compatibility with brass of the cleaner used in Control F was worse.

Oil Separation

Oil separation analyses were conducted to determine the oil-separating characteristics of the cleaning compositions used in Example 2 and Controls C–G. After soil has been removed from a substrate, the soil must be suspended to prevent redeposition. Emulsification and separation are mechanisms for soil suspension. Emulsification and separation can be thought of as opposite ends of a continuous spectrum. Most cleaners fall somewhere between the two poles. Where a cleaner falls along this spectrum is determined by the types of surfactants chosen and the level and type of electrolytes (salts). Temperature and soil-type also affect the degree of separation. Cleaners which separate oils to a greater extent than they emulsify them are preferred in many cleaning applications. Oil separation allows for removal of the soils from the bath by physical means such as, e.g., skimming. Removal of the soil reduces the possibility of redeposition and extends bath life. On the other hand, with emulsification, the soil contaminants become highly dispersed or solubilized throughout the aqueous solution. Such highly emulsified cleaning solutions are difficult to treat to separate the contaminants from the aqueous cleaner. Accordingly, the cleaning solution gets spent in a relatively short period of time and must be replaced to again achieve effective cleaning of the metal parts and the like.

In a first oil separation test, the solutions prepared in Example 2 and Controls D–G were tested for their oil-separating abilities at 100° F. In a second oil separation test, the solutions prepared in Controls C–G were further tested for their oil-separating abilities at 140° F.

Oil separation was determined by the increase in total volume of the test soil after vigorous shaking of the emulsion. Ideally, it is generally beneficial to have no increase or decrease in the total volume of the test soil, because otherwise the oil phase becomes more difficult to treat in wash baths.

In the first oil separation test method, a water bath was prepared and set to a temperature of 100° F. Then, five empty 100 mL graduate cylinders were placed in the heated water bath for preheating. Using distilled water, a 10% diluted solution was made from each of the cleaning solutions for a total of five test cleaning solutions. Five 200 ml-aliquots of the test cleaning solutions (one aliquot per test cleaning solution) were placed on a digital hot plate stirrer (Cole-Parmer cat#. G-04644-20), where each aliquot was mixed well and heated to 100° F. Once they reached 100° F., the aliquots were removed from the hot plate stirrer. About 94 mls of each heated aliquot was then placed in the preheated graduate cylinders (one cylinder per 94 ml-aliquot). To each of the cylinders was added about 6 milliliters of soil. The cylinders were then capped and shaken vigorously for about 30 seconds, using an up and down hand motion. Each cylinder was then placed back into the water bath and a timer started. Upon standing, each aliquot separated into two phases—an oil phase and a water phase. For each aliquot, the volume of both phases was measured and recorded after a 10 minute interval. In addition, for each aliquot, the clarity or cloudiness of the oil phase and the foaminess of the water phase were noted. The results are set forth in Table 11.

The second oil separation test was identical to the first oil separation test except that the temperature of the preheated cylinders and the test cleaning solutions was 140° F. instead of 100° F. The results are set forth in Table 12. In Tables 11 and 12, a result of 100% means that all of the oil added was split by the cleaning solution. Oil separation results greater than 100% indicate that some of the cleaning solution has become emulsified in the oil. Results less than 100% are interpreted as emulsification of some of the oil in the cleaning solution.

TABLE 11

Example 2 and Controls D–G: Oil Separation After 10 Minutes at 100° F.

| Example | Percent Oil |
|---|---|
| 2 | 150 |
| D | 100 |
| E | 83 |
| F | 100 |
| G | 117 |

TABLE 12

Controls C–G: Oil Separation After 10 Minutes at 140° F.

| Control | Percent Oil |
|---|---|
| C | 117 |
| D | 100 |
| E | 117 |
| F | 117 |
| G | 100 |

The results set forth in Table 11 show that, at the lower temperature, the solution of Example 2, which is within the scope of the present invention, formed a larger water-in-oil emulsion than did the control cleaners. This is most likely due to the choice of surfactant used in the Example 2 solution. Surfactants which boost cleaning performance at lower temperature tend to be more hydrophobic in nature and, therefore, are more likely to form water-in-oil emulsions. The impact on cleaning should be minimal since losses due to drag out would dwarf this effect and add-ins added to compensate for drag out would more than make up for these losses. The results presented in Table 11 show that the solution of Control E emulsified some oil in the water.

The results shown in Table 12 indicate that at a temperature of 140° F., the solutions prepared in Controls E and F emulsified small amounts of cleaning solution in the oil. This does not negatively affect oil separation. Small amounts of cleaning solution may be lost in this way, but should not significantly impact cleaning. Losses due to drag out would dwarf this effect and the add-ins added to compensate for drag out would more than make up for these losses.

The increased tendency of the Example 2 solution to form slight water-in-oil emulsions at low temperatures was deemed an acceptable sacrifice in order to obtain superior cleaning at such low temperatures.

Foaming

As stated previously herein, the foaming profile of an aqueous cleaner is an important characteristic of such cleaner because of the problems caused by foam in equipment, particularly spray equipment, such as, e.g., pump cavitation and selective loss of surfactants.

Two foam tests were conducted at high and low temperatures to determine the effect of temperature on the foaming properties of the various test cleaning solutions. In a first foam test, the cleaning solutions prepared in Example 2 and Controls D–G were tested for their tendency to foam at a temperature of 100° F. In a second foam test, the solutions prepared in Controls C–G were tested for their foaming properties at 140° F. In the first foam test, a water bath was set to 100° F. Five empty 100 ml-graduate cylinders were placed in the water bath for preheating. Using distilled water, a 10% diluted solution was made from each of the cleaning solutions for a total of five test cleaning solutions. Five 100 ml-aliquots of the test cleaning solutions (one aliquot per test cleaning solution) were placed on a digital hot plate stirrer (Cole-Parmer cat#. G-04644-20). On the hot plate stirrer, each aliquot was mixed well and heated to 100° F. Once the aliquots reached 100° F., the aliquots were removed from the hot plate stirrer. About 40 mls of each aliquot was then placed in the preheated graduate cylinders (one cylinder per 40 ml-aliquot). Each of the cylinders was then capped and shaken for about 30 seconds, using an up and down hand motion. The shaken cylinders were then placed back into the water bath. The total height of shaken cleaning solution (including the foam layer) in each cylinder was immediately recorded. A timer was started, and the height of each solution was recorded at five minutes. The results are set forth in Table 13.

The second foam test was identical to the first foam test except that the temperature of the preheated cylinders and the test cleaning solutions was 140° F. instead of 100° F. The results are set forth in Table 14.

TABLE 13

Example 2 and Controls D–G: Foaming Results After Five Minutes at 100° F.

| Example | Foam Volume (milliliters) |
|---|---|
| 2 | 60 |
| D | >60 |
| E | 58 |
| F | 7 |
| G | 7 |

TABLE 14

Controls C–G: Foaming Results After Five Minutes at 140° F.

| Control | Foam Volume (milliliters) |
|---|---|
| C | 0 |
| D | >60 |
| E | 15 |

TABLE 14-continued

| Controls C–G: Foaming Results After Five Minutes at 140° F. | |
|---|---|
| Control | Foam Volume (milliliters) |
| F | 0 |
| G | 2 |

The results presented in Table 13 show that, at 100° F., the solutions prepared in Example 2 and Controls D and E were high-foaming products, while the solutions used in Controls F and G were low-foaming products. In general, foaming increased as the temperature decreased. The results set forth in Table 14 show that, at 140° F., the solutions prepared in Controls F and G generated little if any foam. At this temperature, the solutions prepared in Controls D and E were respectively moderate-foaming and high-foaming products.

As can be seen in Table 13, the solution prepared in Example 2, which was within the scope of the present invention, was a high-foaming product at low temperature. It is known that surfactants which clean well at low temperatures tend to be higher foaming. In addition, the aqueous concentrate used to form the Example 2 solution contained approximately 14% by weight of the surfactant. This greater surfactant load also contributed to the foaming. However, because the Example 2 cleaning solution was developed for use in applications involving little or no agitation, higher foaming was deemed to be an acceptable sacrifice for improved cleaning at lower temperatures.

In summary, the results obtained in the examples above show that at lower temperatures, the Example 2 solution, which was within the scope of the present invention, had better cleaning performance and compatibility with a wider variety of metal substrates than did the other solutions tested. The results further show that the cleaning temperature did have an effect on the cleaning performance of the cleaning compositions.

What is claimed is:

1. An alkaline, aqueous metal-cleaning composition comprising:

(A) an active-ingredient portion comprising:

(1) 20% to 80% of an alkalinity-providing component selected from the group consisting of an alkali metal carbonate, an alkali metal bicarbonate, and mixtures thereof; and (2) 20% to 80% of a surfactant mixture comprising:

(a) at least one first non-ionic, ethoxylated linear primary alcohol surfactant having a hydrophobic carbon chain length of from 9 to 11 carbon atoms and being ethoxylated with (i) an average of 2.5 moles of ethylene oxide;

(b) at least one second non-ionic, ethoxylated linear primary alcohol surfactant having a hydrophobic carbon chain length of from 9 to 11 carbon atoms and being ethoxylated with an average of 6.0 moles of ethylene oxide; and (c) at least one third surfactant, wherein the third surfactant is an N-(n-alkyl)-2 pyrrolidone wherein the alkyl group has from 6 to 15 carbon atoms; and (B) an aqueous portion wherein said the aqueous cleaning composition has a pH of from greater than about 7.5 and up to about 11.0.

2. A composition according to claim 1, wherein the alkalinity-providing component comprises a mixture of alkali metal carbonates and alkali metal bicarbonates.

3. A composition according to claim 1, wherein the alkali metal of said carbonate and bicarbonate is sodium or potassium.

4. A composition according to claim 1, wherein the N-(n-alkyl)-2 pyrrolidone surfactant is N-octyl pyrrolidone.

5. A composition according to claim 1, wherein said surfactant mixture (2) further comprises (d) at least one fourth surfactant, wherein said fourth surfactant is selected from the group consisting of anionic surfactants, nonionic surfactants, and mixtures thereof.

6. A composition according to claim 5, wherein said fourth surfactant comprises a mixture of (i) at least one non-ionic, ethoxylated linear primary alcohol surfactant having a hydrophobic carbon chain length of 11 carbon atoms and being ethoxylated with an average of 3.0 moles of ethylene oxide and (ii) at least one non-ionic, ethoxylated linear primary alcohol surfactant having a hydrophobic carbon chain length of 11 carbon atoms and being ethoxylated with an average of 7.0 moles of ethylene oxide.

7. A composition according to claim 1, wherein said surfactant mixture further comprises at least one adjuvant selected from the group consisting of hydrotropes, corrosion inhibitors, polycarboxylates, and defoaming agents.

8. A composition according to claim 1 further comprising from 0% to about 30% by weight of at least one hydrotrope; from 0% to about 10% by weight of at least one corrosion inhibitor; and from 0% to about 2% by weight of a polycarboxylate.

9. A composition according to claim 1, wherein the composition is free of organic solvents.

10. A composition according to claim 1, wherein the aqueous cleaning composition is in the form of an aqueous concentrate comprising from about 5% to about 45% by weight of the active-ingredient portion and from about 55% to about 95% by weight of the aqueous portion.

11. A composition according to claim 1, wherein the aqueous cleaning composition is in the form of an aqueous solution comprising from about 0.1% to about 20% by weight of the active-ingredient portion and from about 80% to about 99.9% by weight of the aqueous portion.

12. A composition according to claim 11, wherein the aqueous cleaning composition comprises about 3.00% by weight of sodium carbonate monohydrate; about 0.25% by weight of sodium bicarbonate; about 2.00% by weight of N-octyl pyrrolidone; about 1.00% by weight of a polyacrylate polymer; about 1.80% by weight of a nonionic, ethoxylated linear primary alcohol surfactant comprising a hydrophobic carbon chain length of from 9 to 11 carbon atoms and being ethoxylated with an average of 2.5 moles of ethylene oxide; about 4.20% by weight of a nonionic, ethoxylated linear primary alcohol surfactant comprising a hydrophobic carbon chain length of from 9 to 11 carbon atoms and being ethoxylated with an average of 6 moles of ethylene oxide; about 0.50% by weight of a nonionic, ethoxylated linear primary alcohol surfactant comprising a hydrophobic carbon chain length of 11 carbon atoms and being ethoxylated with an average of 3 moles of ethylene oxide; about 1.50% by weight of a nonionic, ethoxylated linear primary alcohol surfactant comprising a hydrophobic carbon chain length of 11 carbon atoms and being ethoxylated with an average of 7 moles of ethylene oxide; and about 85.75% by weight of water.

13. A non-aqueous active-ingredient composition which upon being mixed with water forms an aqueous cleaning composition for removing industrial-type soil contaminants from a metal surface comprising:

(1) 20% to 80% of an alkalinity-providing component selected from the group consisting of an alkali metal carbonate, an alkali metal bicarbonate, and mixtures thereof; and (2) 20% to 80% of a surfactant mixture comprising:

(a) at least one first non-ionic, ethoxylated linear primary alcohol surfactant having a hydrophobic carbon chain length of from 9 to 11 carbon atoms and being ethoxylated with (i) an average of 2.5 moles of ethylene oxide;

(b) at least one second non-ionic, ethoxylated linear primary alcohol surfactant having a hydrophobic carbon chain length of from 9 to 11 carbon atoms and being ethoxylated with an average of 6.0 moles of ethylene oxide; and (c) at least one third surfactant, the third surfactant being an N-(n-alkyl)-2 pyrrolidone wherein the alkyl group has from 6 to 15 carbon atoms wherein said resultant aqueous cleaning composition has a pH of from greater than about 7.5 and up to about 11.0.

14. A composition according to claim 13, wherein the N-(n-alkyl)-2 pyrrolidone surfactant is N-octyl pyrrolidone.

15. A composition according to claim 13, wherein said surfactant mixture (A)(2) further comprises (d) at least one fourth surfactant, wherein the fourth surfactant is selected from the group consisting of anionic surfactants, non-ionic surfactants and mixtures thereof.

16. A composition according to claim 15, wherein said fourth surfactant is a surfactant mixture comprising (i) at least one non-ionic, ethoxylated linear primary alcohol surfactant having a hydrophobic carbon chain length of 11 carbon atoms and being ethoxylated with an average of 3.0 moles of ethylene oxide and (ii) at least one non-ionic, ethoxylated linear primary alcohol surfactant having a hydrophobic carbon chain length of 11 carbon atoms and being ethoxylated with an average of 7.0 moles of ethylene oxide.

17. A composition according to claim 13, further comprising an adjuvant selected from the group consisting of hydrotropes, corrosion inhibitors, polycarboxylates, and defoaming agents.

18. A composition according to claim 13, further comprising from 0% to about 30% by weight of at least one hydrotrope; from 0% to about 10% by weight of at least one corrosion inhibitor; and from 0% to about 2% by weight of a polycarboxylate.

* * * * *